US006752837B2

(12) United States Patent
Karp

(10) Patent No.: US 6,752,837 B2
(45) Date of Patent: Jun. 22, 2004

(54) SECURITY TAGS WITH A REVERSIBLE OPTICAL INDICATOR

(75) Inventor: Alan H. Karp, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 10/184,970

(22) Filed: Jun. 28, 2002

(65) Prior Publication Data

US 2004/0000998 A1 Jan. 1, 2004

(51) Int. Cl.[7] ..... G08B 13/14

(52) U.S. Cl. ..... 3400/572.1; 340/572.3; 340/572.5; 235/383; 235/385; 235/384

(58) Field of Search ..... 340/572.1, 572.3, 340/572.5; 235/383, 385, 384

(56) References Cited

U.S. PATENT DOCUMENTS

| | | | | |
|---|---|---|---|---|
| 3,895,368 A | | 7/1975 | Gordon et al. | 340/258 |
| 3,995,900 A | | 12/1976 | Humble et al. | 292/316 |
| 4,063,229 A | | 12/1977 | Welsh et al. | 340/280 |
| 4,510,489 A | | 4/1985 | Anderson, III et al. | 340/572 |
| 4,622,543 A | * | 11/1986 | Anderson et al. | 340/572.1 |
| 4,660,025 A | | 4/1987 | Humphrey | 340/572 |
| 4,686,516 A | | 8/1987 | Humphrey | 340/572 |
| 4,967,185 A | * | 10/1990 | Montean | 340/572.3 |
| 5,006,856 A | | 4/1991 | Benge et al. | 340/572 |
| 5,313,192 A | | 5/1994 | Ho et al. | 340/551 |
| 5,351,033 A | * | 9/1994 | Liu et al. | 340/572.6 |
| 5,495,230 A | | 2/1996 | Lian | 340/551 |
| 5,729,200 A | | 3/1998 | Copeland et al. | 340/551 |
| 5,942,978 A | | 8/1999 | Shafer | 340/572.9 |
| 5,949,318 A | | 9/1999 | Copeland et al. | 335/306 |
| 5,955,951 A | | 9/1999 | Wischerop et al. | 340/572.8 |
| 5,963,173 A | | 10/1999 | Lian et al. | 343/742 |
| 5,979,758 A | | 11/1999 | Swartz et al. | 235/383 |
| 5,990,794 A | | 11/1999 | Alicot et al. | 340/573.1 |
| 6,011,474 A | | 1/2000 | Coffey et al. | 340/572.3 |
| 6,061,552 A | | 5/2000 | Cerasini et al. | 455/128 |
| 6,281,796 B1 | | 8/2001 | Canipe et al. | 340/572.3 |
| 6,307,474 B1 | | 10/2001 | Lian et al. | 340/572.6 |
| 6,320,507 B1 | | 11/2001 | Strzelec et al. | 340/572.1 |
| 6,339,378 B2 | | 1/2002 | Seidel | 340/572.8 |
| 6,351,216 B1 | | 2/2002 | Frederick et al. | 340/572.4 |
| 6,352,606 B1 | | 3/2002 | DiMarco et al. | 156/212 |
| 6,359,563 B1 | * | 3/2002 | Herzer | 340/572.6 |

OTHER PUBLICATIONS

Ryan, Jr., Joseph, "Working Knowledge", Scientific American, p. 120 (May 1997).

Ovonyx, Inc., web site, short technical presentation in HTML, entitled "Ovonic Unifieid Memory", http://www.ovonyx.com/tech$_{13}$html.html, 3 pages (Printed Jun. 18, 2002).

Schmitt, M., et al., "Electrochromic properties of Nb/sub 2/0sub 5/sol–gel Coatings", Solar Energy Materials and Solar Cells, vol. 54, No. 1–4, p. 9–17 (Aug. 1998).

Hoff, F., "Perspectives of Reversible Optical Storage", Slaboproudy Obzor (Journal from Czechoslovakia), vol. 48, No. 4, p. 197–8 (Apr. 1987).

(List continued on next page.)

*Primary Examiner*—Daniel J. Wu
*Assistant Examiner*—Tai T. Nguyen

(57) ABSTRACT

A reusable security tag is provided which is reversibly operable in a first magnetic condition to trigger a detector when the tag is within communication range of the detector, and a second magnetic condition in which the detector is not triggered when the tag is within communication range of the detector. The tag includes an optical indicator which has a first optical characteristic when the tag is in the first magnetic condition, and a second optical characteristic when the tag is in the second magnetic condition.

29 Claims, 2 Drawing Sheets

OTHER PUBLICATIONS

Hsu, A.C.T., "Nucleation and Crystal proliferation Kinetics: *Amorphous*", AIChE Journal, vol. 17, No. 6, p. 1311–15 (Nov. 1971).

Seim H., et al., "Deposition of LaNi03 Thin Films in an Atomic Layer Epitaxy Reactor", Journal of Materials Chemistry, vol. 7, No. 3, p. 449–454 (Mar. 1997).

Mizuguchi, J., et al., "Phase Change of N,N'–bis (2–phenylethyl) perylene–3, 4:9, 10–bis (dicarboximide) for Information Storage Applications", Molecular Crystals and Liquid Crystals Conference (Switzerland), vol. 322, p. 291–8 (1998).

* cited by examiner

SECURITY TAGS WITH A REVERSIBLE OPTICAL INDICATOR

FIELD OF THE INVENTION

The invention relates to methods and apparatus for theft deterrence. More particularly, the invention relates to article surveillance techniques and systems.

BACKGROUND OF THE INVENTION

Article surveillance systems are known in the art. Theft from retail establishments is a major problem, and article surveillance systems attempt to address this problem. To control theft, tags are secured to merchandise, and these tags must be removed or deactivated prior to removal of merchandise from a store or controlled area. If a tag is not removed or deactivated before merchandise is removed, detection equipment or a sensor near an exit will detect the tag and trigger an alarm and/or cause doors past the sensor to become locked.

Various designs of article surveillance systems are known in the art. The tag may include, for example, an electrical circuit which is designed to be resonant at a particular frequency, and the detection equipment may include, for example, two antennas. One of the antennas radiates electrical signals in a band of frequencies that includes the resonant frequency of the tag. The other antenna is tuned to receive signals. Antenna pairs (also known as pedestals) can be positioned to bracket a path or exit such that the only way for a person to exit out of a store or leave a secured area requires passing in between the two antennas. One such antenna pair is described in greater detail in U.S. Pat. No. 6,061,552 to Cerasini et al., which is incorporated herein by reference.

Some tags are permanently deactivatable by applying excessive energy to a resonant circuitry. The excess energy causes a resonant circuit to become deactivated by, for example, causing normally non-conductive material to become conductive. See, for example, U.S. Pat. No. 5,006,856 to Benge et al., which is incorporated herein by reference. Various designs for devices for deactivating tags are described in the following U.S. patents which are incorporated herein by reference: U.S. Pat. No. 5,949,318 to Copeland et al.; U.S. Pat. No. 5,990,794 to Alicot et al.; U.S. Pat. No. 6,011,474 to Coffey et al.; U.S. Pat. No. 6,061,552 to Cerasini et al.; and U.S. Pat. No. 6,281,796 to Canipe et al.

Some tags are capable of being reactivated after being deactivated (e.g., they are reusable). These designs typically involve use of magnetic principles. Attention is directed to the following U.S. patents which relate generally to anti-theft tags, deactivation devices, and pedestals and which are incorporated herein by reference: U.S. Pat. No. 3,895,368 to Gordon et al.; U.S. Pat. No. 3,995,900 to Humble et al.; U.S. Pat. No. 4,063,229 to Welsh et al.; U.S. Pat. No. 4,510,489 to Anderson et al.; U.S. Pat. No. 4,660,025 to Humphrey; U.S. Pat. No. 4,686,516 to Humphrey; U.S. Pat. No. 5,313,192 to Ho et al.; U.S. Pat. No. 5,495,230 to Lian; U.S. Pat. No. 5,729,200 to Copeland et al.; U.S. Pat. No. 5,942,978 to Shafer; U.S. Pat. No. 5,955,951 to Wischerop et al.; U.S. Pat. No. 5,963,173 to Lian et al.; U.S. Pat. No. 6,307,474 to Lian et al.; U.S. Pat. No. 6,320,507 to Strzelec et al.; U.S. Pat. No. 6,339,378 to Seidel; U.S. Pat. No. 6,351,216 to Frederick et al.; and U.S. Pat. No. 6,352,606 to DiMarco et al.

Attention is also directed to an article titled "Antishoplifting Labels," by Joseph Ryan, Jr., appearing in the Working Knowledge column of *Scientific American* magazine, May 1997 issue, page 120. This article describes an anti-shoplifting system that includes a pedestal that brackets a store entrance or checkout aisle and contains a unit that transmits low radio frequency pulses; e.g., 58 kHz. The system further includes a product label including a resonator configured to vibrate at a frequency identical to the transmitted frequency; e.g., 58 kHz, when passed through the pedestal. The product label includes a magnetized strip adjacent to the resonator to ensure that the oscillations of the resonator remain precisely at the transmitted frequency; e.g., 58 kHz. A deactivation device can turn off a label when merchandise is paid for by demagnetizing the strip or altering its magnetic properties such that the resonator either will not vibrate or will do so at a frequency different from the transmitted frequency. A receiver inside one of the pedestal arms turns on between each transmitted pulse (e.g., during an 11 millisecond interval between each transmitted pulse) so that it can pick up the identical signal emitted by the label. If it receives a signal at least four times, an alarm is triggered.

Surveillance tags bearing coded indicia such as bar codes are known in the art. See, for example, U.S. Pat. No. 5,979,758 to Swartz et al., which is incorporated herein by reference.

SUMMARY OF THE INVENTION

The invention provides a reusable security tag, which is reversibly operable in a first magnetic condition, to trigger a detector when the tag is within communication range of the detector, and a second magnetic condition, in which the detector is not triggered when the tag is within communication range of the detector. The tag includes an optical indicator which has a first optical characteristic when the tag is in the first magnetic condition, and a second optical characteristic when the tag is in the second magnetic condition.

One aspect of the invention includes a surveillance system comprising a tag selectively switchable between an active state and an inactive state, the tag including an optical indicator configured to provide an optical indication of whether the tag is in the active state or the inactive state; a first antenna; a second antenna; a transmitter coupled to the first antenna and configured to transmit energy having a predetermined characteristic in an area between the first and second antennas, the tag providing a predetermined detectable output in response to the energy from the transmitter if the tag is in the active state; and a receiver coupled to the second antenna and configured to provide an alarm signal in response to detecting the detectable output of the tag in the area.

DETAILED DESCRIPTION OF THE INVENTION

Figure 1:
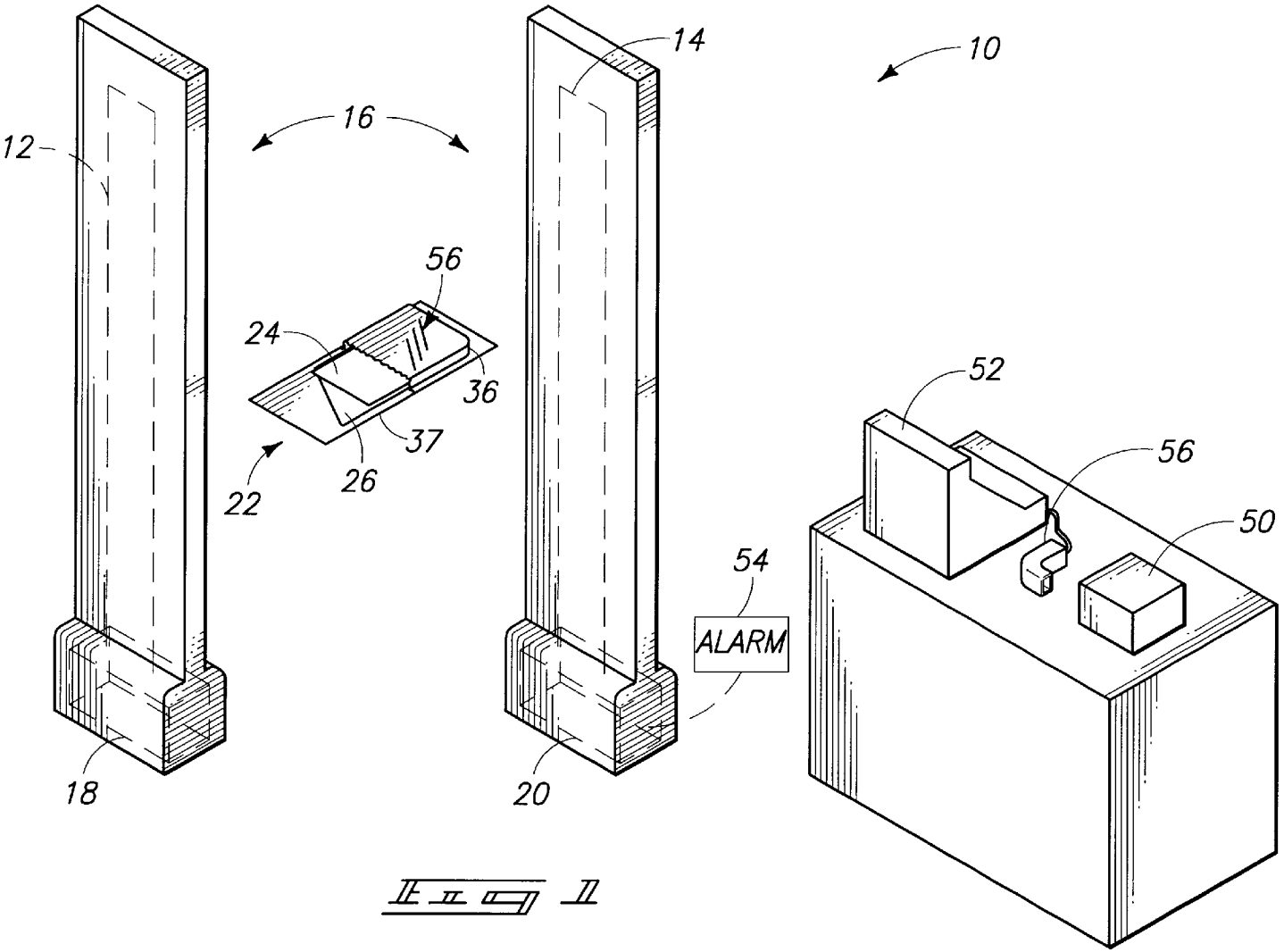
FIG. 1 is a perspective view of an article surveillance system embodying various aspects of the invention, including a tag shown partly broken away and showing an alarm in block diagram form.

FIG. 1 shows a security system 10 embodying various aspects of the invention. The system includes two antennas 12 and 14 which, in one embodiment, are arranged in respective housings to define a pedestal 16 of the type that can be placed so as to bracket a store entrance or placed proximate a checkout aisle. The system includes a transmitter 18 coupled to one of the antennas 12 and 14 and a receiver 20 coupled to the other of the antennas 12 and 14. The antenna 12 coupled to the transmitter 18 transmits pulses at a predetermined frequency.

Figure 2A:
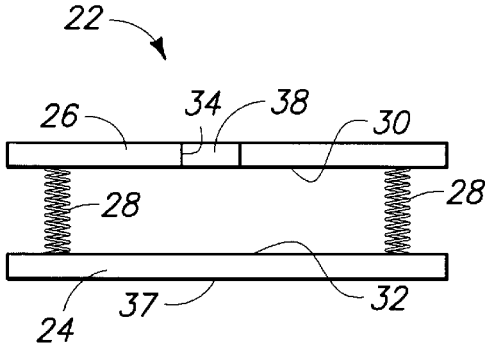
FIG. 2A is a simplified side view of the tag of FIG. 1, illustrating a magnetized state.
Figure 2B:
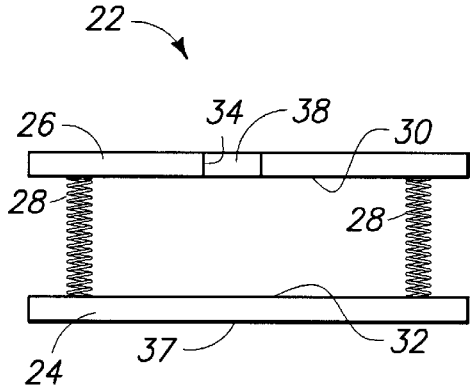
FIG. 2B is a simplified side view of the tag of FIG. 1, illustrating an unmagnetized state.

The system 10 further includes a product label or tag 22 (FIGS. 2A and 2B). The tag 22 includes a resonator 24 which is configured to vibrate at a frequency identical to the transmitted frequency when passed between the antennas 12 and 14. The product label includes a magnetic strip 26 adjacent to the resonator 24 to keep the oscillations of the resonator 24 at the transmitted frequency.

The tag 22 includes (see FIGS. 2A and 2B) one or more pieces 28 of spongy or resilient material separating the strip 26 from the resonator 24. The material could be, for example, foam, rubber, or other resilient material. The material could be only in the corners or dispersed more thoroughly between the resonator and the metal plate. Shallow bores or indents could be used to maintain the material in a desired location, such as in corners. The material could be defined by plastic or metal springs. Any appropriate material or location could be employed.

At least portions of the insides (facing surfaces 30 and 32) of the strip 26 and resonator 24 are made to be at least partially reflecting. One of the strip 26 and resonator 24 has an opening or aperture 34.

The tag 22 further includes a housing or covering 36 (see FIG. 1) which may be, for example, made of plastic or other suitable material. The housing 36 may include a surface 37 which is intended to be affixed to or supported by products or inventory which is to be monitored. A double sided tape or an adhesive, such as a pressure sensitive adhesive, can be provided on this surface.

The tag 22 further includes a partially-silvered (e.g., half-silvered), or one-way mirror 38 or similar device configured to split incoming light such that a portion is reflected in one direction and another portion is transmitted in a second direction different from the first direction. The mirror 38 is supported in or covers the opening or aperture 34 such that the partially-silvered surface faces the surface 32 (if the aperture 34 is in the strip 26) or the surface 30 (if the aperture 34 is in the resonator 24). A half-silvered mirror is one in which reflective molecules coat glass so sparsely that only about half the molecules needed to make the glass an opaque mirror are applied. Reflective molecules are speckled all over the glass in a generally even film, but only half of the glass is covered. The half-silvered surface will reflect about half the light that strikes its surface, while letting the other half go straight through.

The overall size or size range can be the same as for existing tags. In one embodiment, the tags 22 are 1–2 cm long and a few mm wide.

Figure 3:
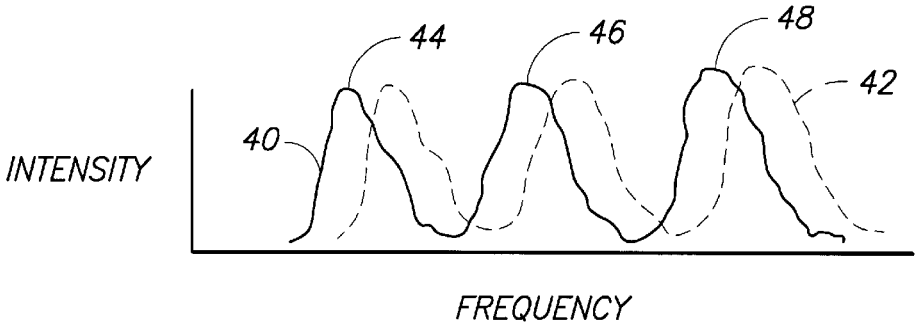
FIG. 3 is a plot of intensity versus frequency and illustrates a shift in frequency that occurs when the tag of FIG. 1 is in the magnetized state versus the unmagnetized state.

When the tag is magnetized (FIG. 2A), the plate 26 and resonator 24 have a slightly different spacing than when the tag is not magnetized (FIG. 2B). Light entering the hole 34 bounces between the plate 26 and the resonator 24. Constructive and destructive interference results in light exiting the hole 34 at a particular set of wavelengths. The spectrum looks, for example, as shown in FIG. 3. When the spacing between the plates changes, the locations of the peaks 44, 46, and 48 shift. For example, plot 40 illustrates intensity versus frequency when the tag is magnetized (FIG. 2A), and plot 42 illustrates intensity versus frequency when the tag is not magnetized (FIG. 2B). This is similar to what happens in Fabry-Perot interferometers used in physics and astronomy.

In the illustrated embodiment, the magnetic force that controls the separation between the resonator 24 and magnetic strip 26 is sufficient to overcome the effects of gravity such that the tag will operate correctly at any orientation, as is the case with present tags.

The shift in frequency between the magnetized and unmagnetized states results in a difference in the color of light that exits the hole 34. This difference gives an optical indication as to the state of magnetization.

The receiver 20 can be, for example, inside one of the pedestal arms or otherwise coupled to the antenna 14. The receiver 20 turns on at least between each transmitted pulse (e.g., during an interval between each transmitted pulse) so that it can pick up the signal emitted by the tag 22 if the resonator is vibrating at the correct predetermined frequency (e.g., the frequency used by the transmitter 18). The resonator 24 will be vibrating at the correct frequency if the strip 26 is magnetized, but will not be vibrating at the correct frequency if the strip 26 is not magnetized.

The system 10 further includes (see FIG. 1) a deactivation device 50 that can turn off the tag when removal of an item is authorized (e.g., after receipt of a payment or accounting procedures have been complied with), by demagnetizing the strip 26 or altering its magnetic properties such that the resonator 24 either will not vibrate or will do so at a frequency different from the transmitted frequency. The deactivation device 50 can be located, for example, proximate a point of sale terminal 52.

The system 10 further includes an alarm 54 coupled to the receiver 20. If the receiver 20 receives the signal from a tag 22 at the correct predetermined frequency, (e.g. once, four times, or some other predetermined number of times), an alarm is triggered. In one embodiment, instead of or in addition to an alarm being triggered, an exit is locked.

Because of the color change, optical examination of the half silvered mirror 38 shows the state of magnetization.

An alternative embodiment, illustrated in FIGS. 4A, 4B, 5A, and 5B, makes use of a change between amorphous and crystalline states of a material to provide a an optical indication of state of magnetization. In some tag designs, such as those described in incorporated U.S. Pat. No. 4,686,516 to Humphrey and U.S. Pat. No. 4,660,025 to Humphrey, the molecular organization of an active component of a tag is changed to activate or deactivate the tag. More particularly, the tag is deactivated by selectively changing a component made of amorphous material to crystalline form, such as by adjusting temperature. Temperature is adjusted in part by applying radiant energy and adjusted in part by conducting electric current through the component. A similar property, based on a change of state responsive to current flow, is used in LCD displays. An optical indicator is provided for tags of this or similar designs.

Figure 4A:
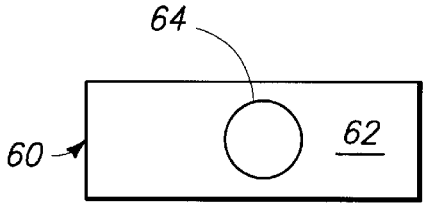
FIG. 4A is a simplified top view of a tag that provides an optical indication of change of state between amorphous and crystalline states, and illustrates the amorphous state.
Figure 4B:
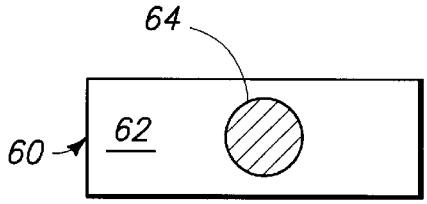
FIG. 4B is a simplified top view of the tag of FIG. 4A, and illustrates the crystalline state.
Figure 5A:
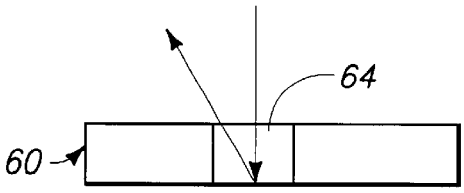
FIG. 5A is a simplified side view of the tag of FIGS. 4A and 4B, illustrating the amorphous state.
Figure 5B:
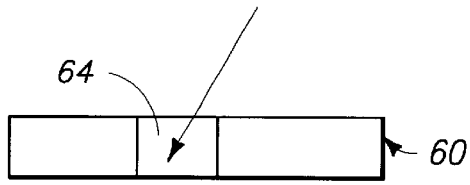
FIG. 5B is a simplified side view of the tag of FIGS. 4A and 4B, illustrating the crystalline state.

FIGS. 4A and 4B show a top view of a tag 60 which make use of this principle. The tag 60 is deactivated by selectively changing a component 62 made of amorphous material to crystalline form, such as by adjusting temperature. Temperature is selectively adjusted either by applying radiant energy, by conducting electric current through the component, or a combination. The tag 60 includes a window 64 made of a polarizing material. The polarizing material in the window can be material of the type that is used in LCD displays, for example, or the type of material used in plastic sunglasses. When the tag material 62 is in its amorphous state (FIG. 4A and FIG. 5A), most of the light reflected from inside the tag 60 is unpolarized, and the window 64 looks white. When the tag material 62 is in the crystalline state (FIG. 4B and FIG. 5B), with the crystal aligned perpendicular to the polarizer in the window 64, very little light escapes the tag 60 and the window 64 looks black.

In another alternative embodiment, the window 64 is not necessarily made of a polarizing material, but is clear in one embodiment, but the material 62 is of a type that changes color or opacity between the amorphous and crystalline states. This material can be, for example, a phase-change chalcogenide alloy. A phase-change chalcogenide alloy changes from high resistance, nonreflective to low resistance reflective as its state changes from amorphous to crystalline. The inventor has recognized that such a material would advantageously change from high resistance, nonreflective, to low resistance, reflective, as its state changes from amorphous to crystalline. These two changes (reflective to nonreflective and amorphous to crystalline) together provide for both the optical indicator and the change in resonance. Another material that could possibly be used includes, for example, N,N'-bis(2-phenylethyl)perylene-3,4:9,10-bis (dicarb oximide) which is discussed in an article by J. Mizuguchi, proceedings of Third Japan-France Joint Forum-Organic Materials for Electronics and Photonics, Apr. 6–8, 1998, Tsukuba, Japan, published in the journal Molecular Crystals and Liquid Crystals. Another material that could possibly be used is an Nb/sub 2/O/sub 5/ or sol-gel niobium oxide which is discussed in an article by M. Schmitt, S. Heusing, M. A. Aegerter, A. Pawlicka, and C. Avellaneda in the journal Solar Energy Materials and Solar Cells, vol. 54, no. 1–4, p. 9–17, August 1998. Other materials that could possibly be used include, for example, TbFe and GaTbFe; TbFeCo; TeSeSb; SeInSb; and alloys with various concentrations of Cu, Al, Ni and Zn such as discussed in an article titled Perspectives of reversible optical storage by F. Hoff, in the Czech journal Slaboproudy Obzor, vol. 48, no. 4, pp.197–8, published April 1987. Another material that could be used is an amorphous-crystalline transformation of basic copper carbonates such as is discussed in an article titled Nucleation and crystal proliferation kinetics: amorphous-crystalline transformation of basic copper carbonates by A.C.T. Hsu, A.C.T. in the AlChE Journal, vol. 17, no. 6, pp.1311–15, published November 1971. Yet another material that could be used is LaNiO3 such as is described in an article by H. Seim; H. Molsa; M. Nieminen; H. Fjellvag; and L. Niinisto in the JOURNAL OF MATERIALS CHEMISTRY, 1997, V7, N3 (MAR), P449–454.

Several applications, in addition to anti-shoplifting applications, are possible. One application is in a warehouse. Items are scanned as they enter using a scanner that changes the magnetization of the tag 22. If a scanned item is removed from the warehouse without authorization, an alarm or alarms are activated. If an item is not scanned as it enters the warehouse, the color of the tag 22 gives immediate feedback of the error. When an item is to be removed from the warehouse, a different scanner that reverses the magnetization is used. Again, the detectable change of the color via the aperture 34 provides feedback. After this second scan, the tag 22 will not activate alarms.

Another application is in a hospital. By some reports, a percentage of the supplies used are never charged to a patient while, at the same time, hospitals are sometimes accused of double charging. Each medical supply item (or selected medical supply items), such as an IV bag, can carry one of the tags 22 which is additionally marked with machine readable markings, such as a bar code or UPC 56. A scanner 56 that reads this bar code is also configured to selectively demagnetize the tag 22 in a manner similar to that described, for example, in incorporated U.S. Pat. No. 5,979,758 to Swartz et al. This change in demagnetization is detectable as a change in color in the light exiting the aperture 34. A simple detectable check will show if the item has been scanned by the scanner 56. If the item is scanned in error, remagnetizing the tag 22 changes the color back. A scanner 56 can be provided particularly for use in returning items to inventory, and this scanner 56 is also capable of remagnetizing the tag 22. In one embodiment, a pedestal 16 or antenna pair 12, 14, is provided at the exit of a garbage collection area. If an unscanned item is discarded, an alarm will sound before the trash is removed from the site.

Various alternatives will be apparent and are intended to be encompassed by the following claims. For example, in one embodiment, the tag 22 is configured with a stiffer elastic material to make the color change undetectable to the human eye, but still detectable by the scanner 56. In this way, the scanner 56 can detect double scanning or the absence of an expected scan. It is also possible to provide special filters that make small color changes visible to the eye.

In another alternative embodiment, an alternative separator piece 28 is used that comprises air or one or more air filled bags. For this embodiment, the bag has the metallic material on each side, and the window in one of the sides. The air pressure would be such that the change in magnetic state would be enough to change the spacing of the metal plates. Alternatively, a foam material could be employed if air-tightness is a problem, but the foam would have to be very compressible and transparent at the wavelengths of interest. Another alternative is to use rigid spacers at the end points. The change in magnetization will cause the metal plates to flex, changing the spacing at the location of the window.

The protection sought is not to be limited to the disclosed embodiments, which are given by way of example only, but instead is to be limited only by the scope of the appended claims.

What is claimed is:

1. A reusable security tag reversibly operable in a first magnetic condition, to trigger a detector when the tag is within communication range of the detector, and a second magnetic condition, in which the detector is not triggered when the tag is within communication range of the detector, the tag including an optical indicator which has a first optical characteristic when the tag is in the first magnetic condition, and a second optical characteristic when the tag is in the second magnetic condition.

2. A reusable security tag in accordance with claim 1 wherein the optical indicator displays a first color when the tag is in the first magnetic condition, and a second color when the tag is in the second magnetic condition.

3. A reusable security tag in accordance with claim 2 wherein the first color is not distinguishable from the second color by the human eye.

4. A reusable security tag in accordance with claim 1 wherein the tag comprises a magnetizable strip and a resonator spaced apart from the strip.

5. A reusable security tag in accordance with claim 4 wherein the first magnetic condition is defined by magnetizing the magnetizable strip, and wherein the second magnetic condition is defined by demagnetizing the magnetizable strip.

6. A reusable security tag in accordance with claim 5 wherein the resonator is configured to resonate at a frequency corresponding to a frequency of a transmission from a transmitter when the magnetizable strip is magnetized.

7. A reusable security tag reversibly operable in a first magnetic condition, to trigger a detector when the tag is within communication range of the detector, and a second magnetic condition, in which the detector is not triggered when the tag is within communication range of the detector, the tag including an optical indicator which has a first optical characteristic when the tag is in the first magnetic condition, and a second optical characteristic when the tag is in the second magnetic condition, the tag comprising a magnetizable strip and a resonator spaced apart from the strip, the first magnetic condition being defined by magnetizing the magnetizable strip, and the second magnetic condition being defined by demagnetizing the magnetizable strip, the resonator being configured to resonate at a frequency corresponding to a frequency of a transmission from a transmitter when the magnetizable strip is magnetized, the security tag further comprising a partially silvered mirror supported by one of the resonator and the strip and including a partially silvered surface facing the other of the resonator and the strip, wherein the optical indicator is defined by the partially silvered mirror.

8. A reusable security tag reversibly operable in a first magnetic condition, to trigger a detector when the tag is within communication range of the detector, and a second magnetic condition, in which the detector is not triggered when the tag is within communication range of the detector, the tag including an optical indicator which has a first optical characteristic when the tag is in the first magnetic condition, and a second optical characteristic when the tag is in the second magnetic condition, the tag including a magnetizable strip and a resonator spaced apart from the strip, the security tag further comprising an aperture in one of the resonator and the strip, and a partially reflective mirror covering the aperture and including a partially reflective side facing the other of the resonator and the strip, the visual optical indicator being defined by the partially silvered mirror.

9. A reusable security tag in accordance with claim 8 wherein the resonator and strip include opposed reflective surfaces.

10. A reusable security tag reversibly operable in a first magnetic condition, to trigger a detector when the tag is within communication range of the detector, and a second magnetic condition, in which the detector is not triggered when the tag is within communication range of the detector, the tag including an optical indicator which has a first optical characteristic when the tag is in the first magnetic condition, and a second optical characteristic when the tag is in the second magnetic condition, the tag including material that is selectively changed between an amorphous state, defining the first magnetic condition, and a crystalline state, defining the second magnetic condition.

11. A reusable security tag in accordance with claim 10 wherein the optical indicator is defined by a window made of a polarizing material.

12. A surveillance system comprising:

a tag selectively switchable between an active state and an inactive state, the tag including an optical indicator configured to provide an optical indication of whether the tag is in the active state or the inactive state;

a first antenna;

a second antenna;

a transmitter coupled to the first antenna and configured to transmit energy having a predetermined characteristic in an area between the first and second antennas, the tag providing a predetermined detectable output in response to the energy from the transmitter if the tag is in the active state; and a receiver coupled to the second antenna and configured to provide an alarm signal in response to detecting the detectable output of the tag in the area.

13. A surveillance system in accordance with claim 12 wherein the tag is capable of being switched back to the active state after being switched to the inactive state.

14. A surveillance system in accordance with claim 12 wherein the optical indicator is configured to change color when the tag is switched from the active state to the inactive state.

15. A surveillance system in accordance with claim 14 wherein the change in color is perceptible by a naked human eye.

16. A surveillance system in accordance with claim 14 wherein the change in color is not perceptible by a naked human eye.

17. A surveillance system in accordance with claim 12 wherein the tag has a housing displaying a bar code.

18. A surveillance system in accordance with claim 17 and further comprising a scanner configured to both read the bar code and change the state of the tag.

19. A surveillance system in accordance with claim 17 and further comprising a scanner configured to substantially simultaneously read the bar code and change the state of the tag.

20. A surveillance system in accordance with claim 12 wherein the tag includes magnetizable material that is magnetized to define the active state and demagnetized to define the inactive state.

21. A surveillance system in accordance with claim 12 wherein the tag includes a magnetizable strip and a resonator spaced apart from the magnetizable strip and configured to resonate at a frequency corresponding to the frequency of the transmitter when the magnetizable strip is magnetized.

22. A surveillance system comprising: a tag selectively switchable between an active state and an inactive state, the tag including an optical indicator configured to provide an optical indication of whether the tag is in the active state or the inactive state, the tag including a magnetizable strip and a resonator spaced apart from the magnetizable strip and configured to resonate at a frequency corresponding to the frequency of the transmitter when the magnetizable strip is magnetized, the tag further including a partially silvered mirror supported by one of the resonator and the strip and a partially silvered surface facing the other of the resonator and the strip, the optical indicator being defined by the partially silvered mirror;

a first antenna;

a second antenna;

a transmitter coupled to the first antenna and configured to transmit energy having a predetermined characteristic in an area between the first and second antennas, the tag providing a predetermined detectable output in response to the energy from the transmitter if the tag is in the active state; and a receiver coupled to the second antenna and configured to provide an alarm signal in response to detecting the detectable output of the tag in the area.

23. A surveillance system comprising:

a tag selectively switchable between an active state and an inactive state, the tag including an optical indicator configured to provide an optical indication of whether the tag is in the active state or the inactive state, the tag including a magnetizable strip and a resonator spaced apart from the magnetizable strip and configured to resonate at a frequency corresponding to the frequency of the transmitter when the magnetizable strip is magnetized, the tag further including an aperture in one of the resonator and the strip, a partially reflective mirror supported in the aperture and a partially reflective side facing the other of the resonator and the strip, the optical indicator being defined by the partially silvered mirror;

a first antenna;

a second antenna;

a transmitter coupled to the first antenna and configured to transmit energy having a predetermined characteristic in an area between the first and second antennas, the tag providing a predetermined detectable output in response to the energy from the transmitter if the tag is in the active state; and a receiver coupled to the second antenna and configured to provide an alarm signal in response to detecting the detectable output of the tag in the area.

24. A surveillance system in accordance with claim 23 wherein the resonator and the strip include opposed reflective surfaces.

25. A surveillance system comprising:

a tag selectively switchable between an active state and an inactive state, the tag including an optical indicator configured to provide an optical indication of whether the tag is in the active state or the inactive state, the tag including material that is selectively changed between an amorphous state, defining the active state, and a crystalline state, defining the inactive state, and the optical indicator being defined by a window made of a polarizing material and facing the material that is selectively changed between the amorphous state and crystalline state, whereby when the material is in the amorphous state, much of the light reflected from inside the tag is unpolarized and the window looks white, and whereby when the material is in the crystalline state, little light escapes the tag and the window looks black;

a first antenna;

a second antenna;

a transmitter coupled to the first antenna and configured to transmit energy having a predetermined characteristic in an area between the first and second antennas, the tag providing a predetermined detectable output in response to the energy from the transmitter lithe tag is in the active state; and a receiver coupled to the second antenna and configured to provide an alarm signal in response to detecting the detectable output of the tag in the area.

26. A surveillance system comprising:

a tag selectively switchable between an active state and an inactive state, the tag including an optical indicator configured to provide an optical indication of whether the tag is in the active state or the inactive state, the tag including material that is selectively changed between an amorphous state, defining the active state, and a crystalline state, defining the inactive state, and that changes color between the amorphous and crystalline states, and the optical indicator being defined by a window facing the material that is selectively changed between the amorphous state and crystalline state;

a first antenna;

a second antenna;

a transmitter coupled to the first antenna and configured to transmit energy having a predetermined characteristic in an area between the first and second antennas, the tag providing a predetermined detectable output in response to the energy from the transmitter if the tag is in the active state; and a receiver coupled to the second antenna and configured to provide an alarm signal in response to detecting the detectable output of the tag in the area.

27. A surveillance system in accordance with claim 26 wherein the material that is selectively changed between an amorphous state and a crystalline state comprises a phase-change chalcogenide alloy.

28. A surveillance system comprising:

a tag selectively switchable between an active state and an inactive state, the tag including an optical indicator configured to provide an optical indication of whether the tag is in the active state or the inactive state, the tag including material that is selectively changed between an amorphous state, defining the active state, and a crystalline state, defining the inactive state, and that changes opacity between the amorphous and crystalline states, and the optical indicator being defined by a window facing the material that is selectively changed between the amorphous state and crystalline state;

a first antenna;

a second antenna;

a transmitter coupled to the first antenna and configured to transmit energy having a predetermined characteristic in an area between the first and second antennas, the tag providing a predetermined detectable output in response to the energy from the transmitter it the tag is in the active state; and a receiver coupled to the second antenna and configured to provide an alarm signal in response to detecting the detectable output of the tag in the area.

29. A surveillance system in accordance with claim 28 wherein the material that is selectively changed between an amorphous state and a crystalline state comprises a phase-change chalcogenide alloy.

* * * * *